United States Patent [19]

Chan et al.

[11] Patent Number: 5,016,023

[45] Date of Patent: May 14, 1991

[54] LARGE EXPANDABLE ARRAY THERMAL INK JET PEN AND METHOD OF MANUFACTURING SAME

[75] Inventors: C. S. Chan; Conrad L. Wright; Gary E. Hanson, all of Boise, Id.

[73] Assignee: Hewlett-Packard Company, Palo Alto, Calif.

[21] Appl. No.: 417,936

[22] Filed: Oct. 6, 1989

[51] Int. Cl.[5] ..... B41J 2/05

[52] U.S. Cl. ..... 346/1.1; 29/890.1; 346/140 R

[58] Field of Search ..... 346/140, 1.1

[56] References Cited

U.S. PATENT DOCUMENTS

| | | | |
|---|---|---|---|
| 4,520,373 | 5/1985 | Ayata | 346/140 |
| 4,580,148 | 4/1986 | Domoto | 346/140 |
| 4,633,274 | 12/1986 | Matsuda | 346/140 |
| 4,683,481 | 7/1987 | Johnson | 346/140 |
| 4,829,324 | 5/1989 | Drake | 346/140 |
| 4,914,736 | 4/1990 | Matsuda | 346/140 |
| 4,922,269 | 5/1990 | Ikeda | 346/140 |

FOREIGN PATENT DOCUMENTS 19367 1/1986 Japan .

*Primary Examiner*—Joseph W. Hartary

[57] ABSTRACT

A hybrid type thermal ink jet (TIJ) pen and method of manufacture wherein a plurality of individual thin film ink jet printheads, each including an orifice plate, are selectively spaced on and secured to an insulating substrate having ink feed ports therein which supply ink to the printheads. Buss lines and integrated circuit driver-decoder packages may be mounted in a planar fashion with respect to the printheads and electrically interconnected to drive the printheads.

Alternatively, the individual printheads may be mounted on a unitary insulating support and ink feed structure such as a ceramic substrate and interconnected to off-substrate TIJ driver circuitry by way of printed or silk-screened electrical leads. These leads may be laid down in a controlled pattern on the surface of the ceramic substrate and used to interconnect bonding pads on the TIJ printheads with the above off-substrate driver circuitry and power supplies. If desired, integrated circuit packages may be mounted in slots cut in the ceramic substrate in a planar arrangement with respect to the printheads.

17 Claims, 2 Drawing Sheets

LARGE EXPANDABLE ARRAY THERMAL INK JET PEN AND METHOD OF MANUFACTURING SAME

TECHNICAL FIELD

This invention relates generally to multiple printhead and multiple orifice plate ink jet pens and more particularly to an expandable array of ink jet printheads which may be constructed in a planar and compact arrangement suitable for high yield fabrication and at high packing densities.

BACKGROUND ART

In the field of ink jet printing, various approaches have been taken to increase the printing speed of ink jet printers, and one such approach to this problem is to increase the pen operating frequency. But this solution sometimes suffers from problems associated with overheating and overdriving the printhead resistors or other associated transducer elements and also problems associated with ink meniscus instability when the ink jet nozzles are driven at high speeds.

Another solution to increasing printer speed has been to increase the number of ink jet ejection orifices in the output orifice plate or orifice plates (also sometimes referred to as nozzle plates). However, when one attempts to increase the size of an orifice plate in order to accommodate for a corresponding increase in the number of ink ejection orifices, it becomes increasingly difficult to provide good interface bonding between, for example, a metal orifice plate of large area and an underlying substrate support member. The substrate support member will, for example, normally be an insulating material having a thermal expansion coefficient substantially different from that of the metal orifice plate material. Therefore, when one attempts to bond large area metal orifice plates with matching large area insulating substrates by utilizing a combination of heat and pressure in a heat staking process, the above mismatch in thermal expansion coefficients produces an unacceptable bowing in the sandwich structure thus produced, and this design flaw in turn greatly reduces yields and mean time to failure.

DISCLOSURE OF INVENTION

The general purpose of this invention is to provide a novel alternative approach to large size ink jet pen construction which simultaneously overcomes the above problems associated with: (1) low yields, (2) thermal expansion coefficient (TEC) mismatched sandwich structures and related electrical interconnect problems, and (3) the overheating associated with attempts to overdrive ink jet printhead resistors or other transducers.

To accomplish this purpose, we have discovered and developed a novel large expandable array thermal ink jet pen and method of ink jet pen manufacture wherein there is initially provided an insulating substrate, such as a ceramic substrate, suitable for withstanding certain elevated temperatures. A plurality of individually diced ink jet printheads are positioned on the substrate in a predetermined spaced relationship, and each printhead is fluidically connected to an ink feed port in the substrate for receiving therefrom a particular color of ink. These printheads may be operated in either a single color ink jet pen or in multicolor ink jet pen (or pen/-plotter). In a preferred embodiment of the invention, the printheads are offset with respect to adjacent printheads by an amount at least equal to a width dimension of a printhead, and the printheads are electrically connected to a remote buss line. This may be accomplished, for example, by means of a thin flat electrical cable, such as a tape automated bond (TAB bond) flexible circuit. This connection is suitable for providing "power", "ground", "clock", "enable" and "data" signal inputs from an external signal or power source to the plurality of ink jet printheads. Advantageously, decoder-driver integrated circuit packages may be mounted in a planar arrangement adjacent to the ink jet printheads and electrically connected thereto in a compact, high density planar mounting arrangement.

The various advantages and novel features of this invention will become better understood in the following description of the accompanying drawings.

DETAILED DESCRIPTION OF THE PREFERRED EMBODIMENTS

Figures 1, 2:
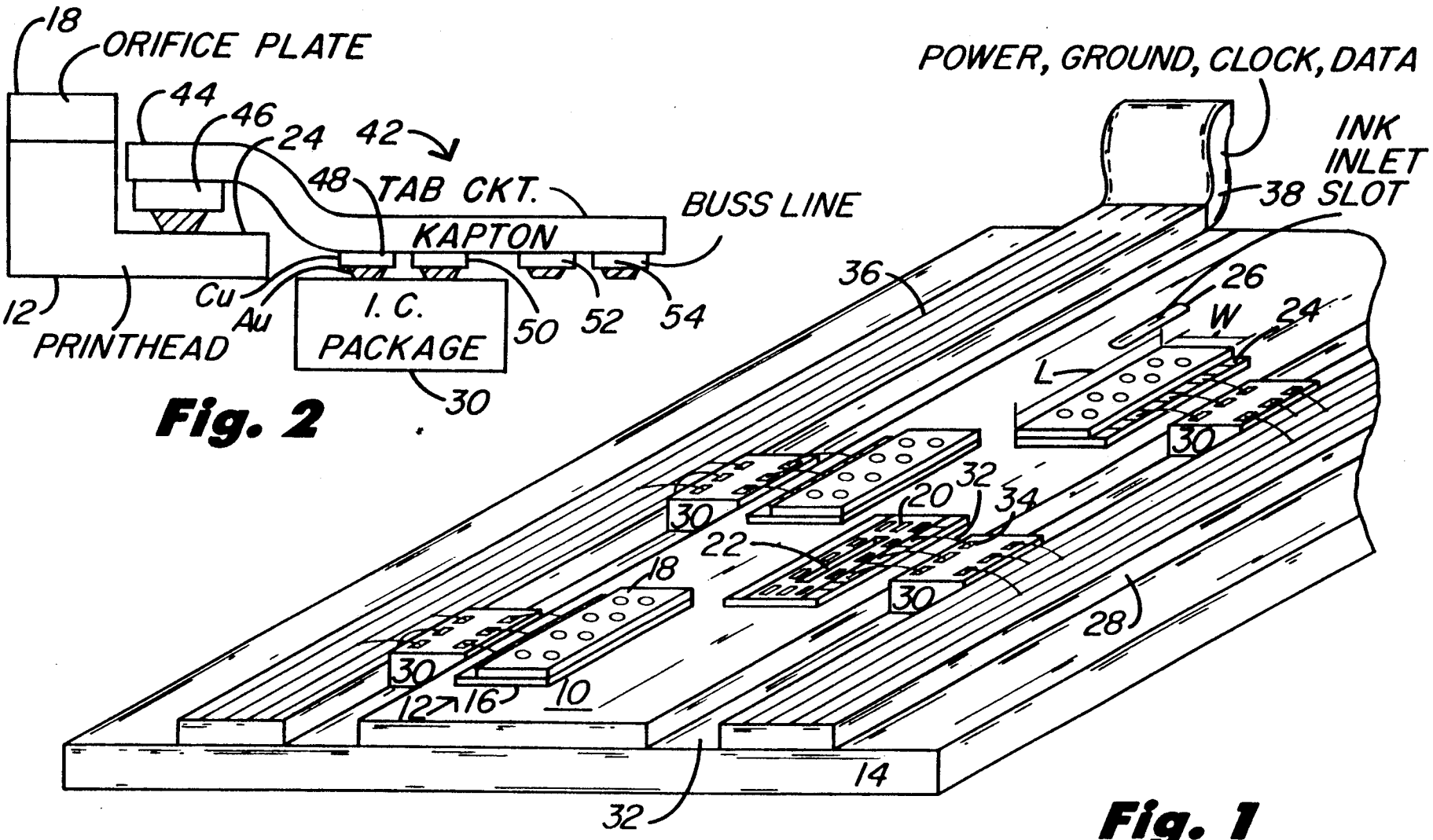
FIG. 1 is an isometric view of one embodiment of the invention showing the printheads, buss lines and IC packages mounted side-by-side in a planar hybrid array.
FIG. 2 is a cross section view illustrating how a TAB bond flex circuit may be used to make an electrical connection between the printheads and ICs in FIG. 1 to thereby eliminate the specific buss line construction in FIG. 1.

Referring now to FIG. 1, there is initially provided a printhead carrier insulating substrate 10, such as a ceramic material suitable for withstanding certain elevated temperatures. The substrate 10 also provides a good flat die bonding surface for receiving a plurality of thermal ink jet printheads 12 which are die bonded thereto in a predetermined offset spaced relationship to be further described. The ceramic carrier substrate 10 will typically be secured to a larger underlying supporting member 14 such as a printed circuit board or card or other larger member suitable for handling and insertion into a carriage member of a thermal ink jet printer.

A total of five (5) thermal ink jet printheads 12 are shown in FIG. 1, but it will be appreciated that this number of printheads can be substantially expanded depending upon the particular application of the ink jet pen under construction. Each of the printheads 12 will typically contain an underlying thin film substrate and barrier layer portion 16 and an overlying metal orifice plate member 18 which may be adhesively bonded to the substrate and barrier layer portion using bonding and orifice plate alignment techniques known to those skilled in the art. These printheads 12 comprising an underlying thin film substrate and barrier layers 16 and an orifice plate 18 are initially formed on a larger silicon wafer (not shown) and then diced into the rectangular geometry shown in FIG. 1 so as to leave discrete thermal ink jet printheads which are typically 0.25" by 0.6" and of a thickness of about 20–25 mils. These types of thermal ink jet printheads and related ink feed and head mounting designs are Gary E. Hanson, in U.S. Pat. No. 4,771,295 issued to Jeffrey P. Baker et al, and in U.S. Pat. No. 4,809,428 issued to J. S. Aden et al, all assigned to the present assignee and incorporated herein by reference. These printheads and the materials sets and orifice plates used in their construction are also described in the *Hewlett-Packard Journal,* Vol. 38, No. 5, May 1985, and in the *Hewlett-Packard Journal,* Vol. 39, No. 4, August 1988, also both incorporated herein by reference.

The substrate and barrier layer portion 16 of the thin film printhead 12 will typically consist in layer sequence of a glass or silicon substrate underlayer, a $SiO_2$ surface barrier layer, a tantalum-aluminum resistor layer, an aluminum conductive trace material, a silicon nitride and silicon carbide composite passivation layer, and a polyimid barrier layer such as a VACREL polymer made by the DuPont Company. The metal orifice plate 12 will typically consist of a nickel layer which has been plated with gold and either perforated or electroformed to have the desired number of orifice openings therein. Electroforming processes for forming nickel orifice plates are disclosed and claimed in U.S. Pat. Nos. 4,716,243 and 4,694,308 issued to C. S. Chan et al, assigned to the present assignee and incorporated herein by reference. However, the present invention is not limited to the use of any particular types of metal orifice plates, and other orifice plates such as a compound bore orifice plate disclosed and claimed in U.S. Pat. No. 4,675,083 or a transparent plastic orifice plate such as the one disclosed and claimed in U.S. Pat. No. 4,829,319 may also be used in constructing the thermal ink jet printheads 12. The latter two patents issued to C. S. Chan et al and assigned to the present assignee are also incorporated herein by reference.

Each of the thin film transducer substrates 16 includes a plurality of heater resistor transducer elements 20 spaced around an elongated ink feed slot 22 as indicated. Each of the heater resistors 20 will be connected by way of a suitable conductive trace material (not shown) and in a manner well understood in the art and to a corresponding plurality of peripheral interconnect pads 24 which serve as bonding pads for making electrical lead-in connections from external circuitry. These bonding pads are further described in U.S. Pat. No. 4,812,859 issued to C. S. Chan et al and incorporated herein by reference, and they are also described in U.S. Pat. No. 4,862,197 issued to John L. Stoffel, assigned to the present assignee and also incorporated herein by reference.

Each of the elongated ink feed slots 22 and each of the thermal ink jet printheads 12 which are fluidically connected thereto may either be connected to a common ink feed slot (not shown) in the printhead carrier insulating substrate 10 for receiving a single color of ink or they may be connected to a separate ink feed conduit or port 26 for carrying different colors of ink. These isolated slots 26 are fluidically isolated one from another so as to provide different colors of ink such as cyan, magenta and yellow colors of ink to the individual thermal ink jet printheads 12. In addition, the underlying slots 26 in the ceramic carrier substrate 10 which couple to the matching slots 22 in the printheads 12 may also be aligned to connect to other ink feed slots, ports or fluid flow lines (not shown) in the larger underlying and supporting circuit board card or carrier 14 using known ink channel construction techniques. One technique for matching the header substrate ink feed slot and the printhead ink feed slot is described in U.S. Pat. No. 4,683,481 issued to Samuel A. Johnson, assigned to the present assignee and also incorporated herein by reference.

In the lengthwise or "L" dimension of the printhead 12 as shown in FIG. 1, there will be some small spacing from printhead to printhead in order to provide the necessary ink ejection isolation between adjacent printheads. In the width or "W" dimension, each adjacent printhead is offset from the next printhead by at least the printhead width dimension "W", also to insure proper ink isolation from printhead to printhead and also to better accommodate the construction of ink conduits in the underlying substrate and feeding the individual printheads. For a further discussion of the above "L" and "W" dimensions and the corresponding design of a slot-fed multichamber multicolor pen having offset adjacent printheads, reference may be made to the above identified U.S. Pat. No. 4,812,859 issued to C. S. Chan et al.

The ink flow in the expandable pen described herein is normally upward through an ink feed slot 26 in the ceramic substrate 10 and then laterally over the individual heater resistors 20 within each printhead where the ink will be temporarily confined beneath the upper orifice plate 18 prior to ejection. A polymer barrier layer such as the well known polyimid adhesive VACREL separates these heater resistors and orifice plates in a known manner, and this printhead construction is described in the above-identified technical articles appearing in the *Hewlett-Packard Journal* in May 1985 and August 1988.

A pair of buss substrates 25 and 27 are positioned as shown on each side of the ceramic substrate 10, and each of the buss substrates 25 and 27 will typically carry a plurality of individual buss lines 29 in the adjacent parallel relationship shown. These lines 29 may be used, for example, as "power", "ground", "clock", "data 1 through data "n", "control" and "enable" lines as indicated in FIG. 1. The buss substrates 25 and 27 are spaced from and firmly secured a predetermined distance from the ceramic substrate 10. This leaves a slot shaped clearance 32 as shown for receiving a plurality of decoder-driver integrated circuit (IC) packages 30 which are positioned in the slot 32 in a planar fashion. That is, the top surfaces of these integrated circuit packages 30 will lie in substantially the same plane as the planes of the orifice plates 18 and the top surfaces of the buss substrates 25 and 27 previously described.

The above design for mounting IC packages in slotted regions of a substrate member of a printhead is, per se, known in the art and is described, for example, in U.S. Pat. No. 4,571,826 issued to Norman A. Jacobs and incorporated herein by reference. This mounting arrangement insures that the exposure of the IC packages to wear and contact with closely adjacent mechanisms is minimized and that the packing density for the overall printhead array is high and is maintained essentially two dimensional in nature. This arrangement exhibits an overall flat planar top surface with no significant vertically extending protrusions which might otherwise interfere with a print medium spaced closely adjacent to the ink ejection orifices of the orifice plates 18. However, since Jacobs uses a single thermal head fed by a plurality of ICs, there is no provision or suggestion in the Jacobs pen of using a plurality of thermal ink jet printheads on a common underlying substrate and fed by a plurality of ink feed channels and driven by a plurality of ICs as described above.

Conventional wire bonding processes such as single point TAB bonding may be used to wire bond the electrical contact pads 19 of the printheads 12 to selected contact points 34 on the IC packages 30 and also to wire bond other selected contact pads 36 of the IC packages to the individual buss lines 29 previously described. However, another approach for making the above electrical connection is to use a thin flat flex circuit (not shown) which is first placed in position over the printhead contact pads, the IC packages and the buss lines and then compression bonded at preselected connection points to the printhead, IC package and buss lines in order to improve the overall planarity of the large expandable printhead array in accordance with the present invention. One such a flex circuit bonding arrangement is shown in more detail below in FIG. 2.

Referring now to FIG. 2, there is shown an enlarged cross section view of a TAB circuit bonded at the left end to the thermal ink jet printhead and in the center to a driver integrated circuit. In this arrangement, the buss substrates in FIG. 1 are replaced with the downward facing buss lines on the right end of the TAB circuit. The TAB circuit shown in FIG. 2 is designated generally 42 and includes an insulating KAPTON substrate 44 which is flexible and includes wiring patterns therein (not shown) which are selectively connected to the underside metal contacts. These contacts typically include a copper component 46, 48, 50, 52 and 54 and a gold contact component on the underside of the copper components, with the gold components making electrical contact as shown with the printhead 12 and the IC package 30. In FIG. 2, the two right side buss lines 52, 54 take the place of the buss line members 25 and 27 in FIG. 1. Thus, it can be seen that the TAB circuit in FIG. 2 provides a substantially overall planar arrangement atop the printheads 12 and IC packages 30. The actual contact bonding for the structure in FIG. 2 may be made by means of computer controlled and centered compressive bonding forces which are applied to the top surface of the KAPTON layer 44 and centered directly above the copper contact support members 46, 48, 50, 52 and 54. In addition, the buss lines such as 52 and 54 are selectively and internally connected within the KAPTON layer 44 to certain ones of the IC package contacts 48, 50 and to certain ones of the TIJ printhead contacts 46.

It should be understood that the relative heights of the various components in FIG. 2 are shown by way of example only, and the position of these components may be varied in accordance with a particular pen application. For example, it is possible to raise and lower the height of (vertical location of) the IC package 30 in order to enhance the overall planarity of the structural combination of components shown in FIG. 2 and, for example, enable the top surface of the IC package 30 to be flush with the bonding surface 24 of the TIJ printhead 12.

Figure 3:
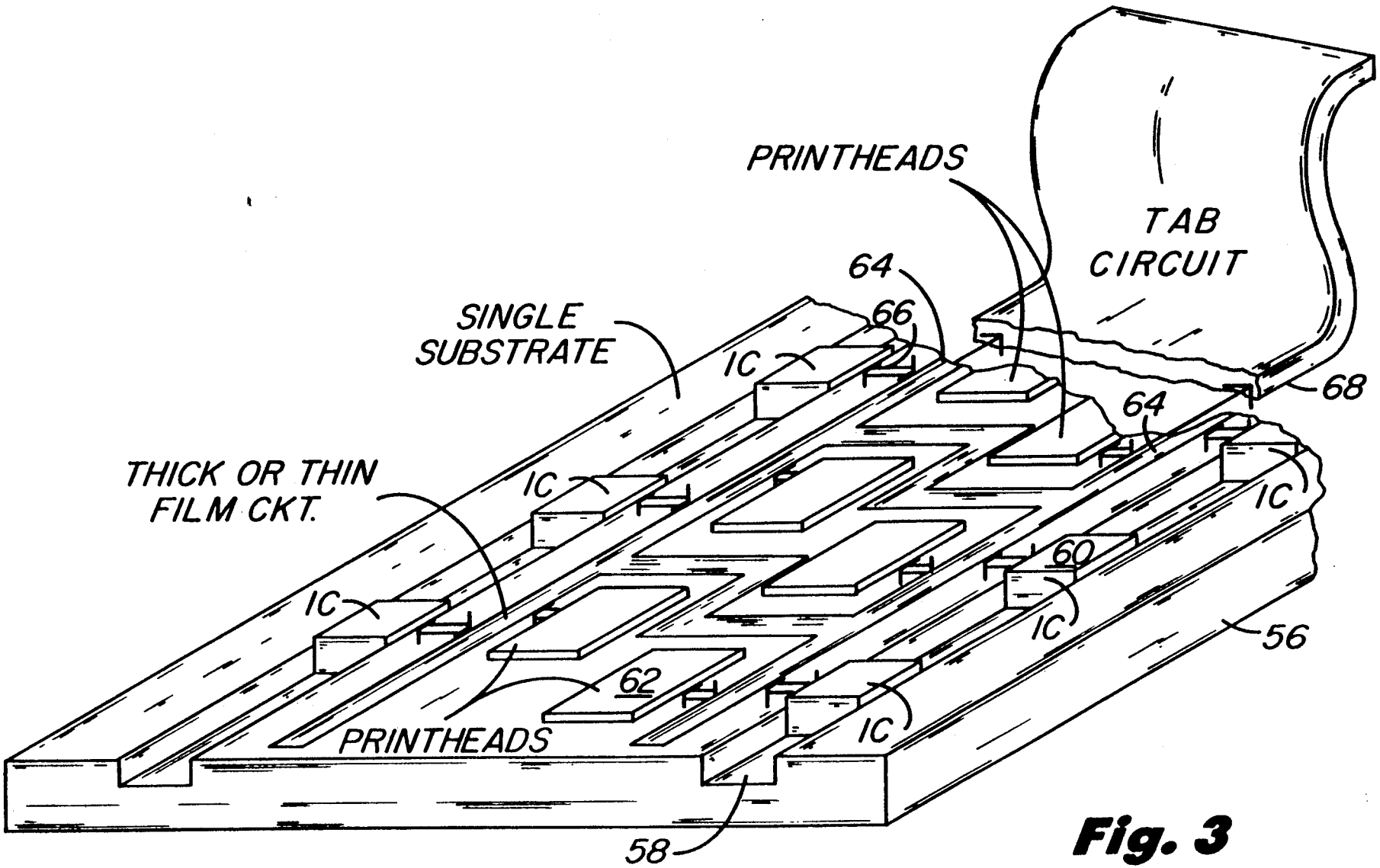
FIG. 3 is an isometric view of another embodiment of the invention wherein the printheads, IC packages and buss lines are disposed in a planar arrangement on a single substrate.

Referring now to the alternative embodiment of the invention shown isometrically in FIG. 3, a single ceramic substrate 56 is used for supporting the IC packages 60 and TIJ printheads 62 as indicated. A slot 58 has been cut in the substrate 56 and receives the individual IC packages 60 as shown, and a patterned thick or thin film printed circuit 64 has been deposited on the top surface of the substrate 56. This thick or thin film circuit 64 is used for electrically interconnecting the IC packages 60 to the printheads 62 and also for electrically connecting the entire printhead array to an off-substrate TAB circuit 68. The double-line double arrow connections shown in FIG. 3 represent any one of several available electrical interconnect schemes which are suitable for interconnecting the TIJ printhead contact pads with contact points on the IC packages as previously indicated. These interconnect schemes include ultrasonic or thermocompression or thermosonic wire bonding, single point TAB bonding and TAB flex circuit bonding of the type described above.

Thus, the embodiment of FIG. 3 does not require an additional underlying substrate support member as shown in FIG. 1 and instead may be mounted on or inserted directly into a TIJ printer carriage where the TAB circuit 68 may be further connected to other printer control circuitry (not shown).

Various modifications may be made in and to the above described embodiments without departing from the scope of this invention. For example, instead of using IC packages which are mounted in slots as described above, it is possible to integrate the IC decoder-driver circuitry right into the silicon substrate material of the individual thin film printheads, thereby eliminating the need for the larger IC packages. Many different types of so-called "on-chip" IC decoder-driver and multiplex circuitry have been disclosed in prior U.S. Patents. See for example U.S. Pat. No. 4,695,853 issued to David Hackleman et al and U.S. Pat. No. 4,719,477 issued to Ulrich Hess, both assigned to the present assignee and incorporated herein by reference. See also U.S. Pat. No. 4,532,530 issued to W. G. Hawkins for a discussion of chip-integrated driver circuitry.

It may also be feasible for certain types of printing applications to use a high temperature plastic preform substrate starting material and then shape and configure such material using known processes such as hot press stamping and bending processes to first form a plurality of rectangular sunken receptacles in a central area of the preform and then bend the outer areas of the preform to a desired rounded contour. This contour may, for example, be made to conform to the shape of the outer surface of a relatively large ink supply housing. Also as an example in this proposed embodiment, in two adjacent rows of rectangular receptacles in a central area of the preform, every other receptacle in a row will receive a printhead and the alternate remaining intermediate receptacles will receive an IC package or other desired on-board (on-preform) component in a high density planar packing arrangement.

The receptacle depth of the above sunken receptacles can be varied and controlled so that the top surfaces of the printheads (their orifice plates) and the top surfaces of the IC packages or other components are substantially flush with the top surface of the central area of the preform. Then, a TAB bond flex circuit or the like can be laid down over the rounded areas of the bent preform in a slanted contour and with an electrical connection similar to that described in the above identified U.S. Pat. No. 4,635,073 issued to Gary E. Hanson. In addition, this novel alternative arrangement will allow one to use injection molding processes or the like to form both the ink feed ports and the electrical wire feed ports in the plastic preform. It will also allow one to form both vertical and lateral ink feed conduits within the plastic preform, and these conduits may in turn be connected into matching conduits of the individual thin film printheads.

Such an alternating positioning of IC packages and TIJ printheads in each row of receptacles not only would provide the above-described necessary isolation between the closest adjacent TIJ printheads, but it would also maximize the packing density of components mounted on the preform. That is, substantially all of the central area of the preform can be used to form the sunken receptacles. In addition, it would maximize packing density in a substantially two dimensional planar array and using low cost, known and well developed plastic shaping processes such as the well known injection molding processes. Furthermore, there would be provided a good match between the thermal expansion coefficients of the plastic IC package, the insulating flex circuit, the thin film TIJ printheads and the plastic substrate derived from the plastic preform.

There are also many fluid (ink) control and fluid flow design possibilities which may be selected consistent with the teachings of the present invention but which, for sake of simplicity herein, have not been shown in the drawings. For example, instead of having one ink feed port per printhead as shown in FIG. 1, several printheads may be dedicated to receive ink from one common ink feed slot. Then several other printheads may be dedicated to another common ink feed slot located in the underlying ceramic substrate support member.

On the other hand, it may be desirable to feed each individual printhead with three colors of ink (and black if desired) in order to operate each printhead as a 3-color ink jet pen. In this case, it might be desirable, for example, to use the ink distribution techniques similar to those described in the above identified U.S. Pat. No. 4,771,295 issued to Jeffrey Baker et al and provide cyan, yellow and magenta colors of ink through fluidically isolated paths and to hydraulically isolated heater resistors on the active surface of a thin film ink jet printhead. Ink supplies of these three colors of ink (not shown) can be secured to the underside of the printed circuit board carrying the ceramic substrate, or to the ceramic substrate itself. Also, if desired, the on board printhead ink supply may be connected to an "off-board" ink supply in the manner described in U.S. Pat. No. 4,831,381 issued to C. S. Chan and assigned to the present assignee and also incorporated herein by reference.

Finally, it will also be understood that the present invention is not limited to TIJ technology, but may also be used with piezoelectric transducers or other types of ink jet printheads adaptable for mounting in a novel hybrid large expandable array as described above.

I claim:

1. A process for manufacturing an expandable array ink jet pen which comprises:
   a. providing an insulating substrate having a plurality of ink flow ports therein,
   b. securing a plurality of discrete ink jet printheads to said insulating substrate in a predetermined spaced relationship and being fluidically coupled thereon to said ink flow ports, respectively, each printhead having a supporting thin film substrate and an overlying orifice plate, and one or more ink propulsion transducers on said thin film substrate for propelling ink through an opening or openings in said orifice plate, said printheads being individually mounted on said substrate, and
   c. laterally offsetting each printhead with respect to each adjacent printhead by at least a distance equal to or greater than a width dimension of said printhead.

2. The process defined in claim 1 which further includes mounting said printheads on a common substrate having IC packages and substrate wiring thereon, said wiring being used to interconnect said printheads and IC packages and also used to interconnect said printheads and said IC packages to off-substrate external circuitry.

3. The process defined in claim 1 which further includes:
   a. providing a plurality of buss lines remote from said insulating substrate, and
   b. electrically connecting individual ones of said buss lines to said printheads to thereby provide electrical lead-in drive connections to said printheads.

4. The process defined in claim 3 which further includes:
   a. placing a plurality of driver integrated circuits adjacent said insulating substrate, and
   b. electrically connecting selected ones of said buss lines to said driver integrated circuits which provide drive and decode functions for said printheads.

5. A hybrid expandable ink jet printhead array comprising a common insulating substrate having a plurality of ink feed ports therein and a plurality of discrete ink jet printheads therein aligned on said substrate and being fluidically connected, respectively, to said ink feed ports for receiving ink therefrom during an ink jet printing operation, each printhead including a supporting thin film substrate and an overlying orifice plate, and ink propulsion transducers on said thin film substrate for propelling ink through an opening or openings in said orifice plate, said printheads being individually mounted on said common insulating substrate, and each of said printheads being laterally offset with respect to each adjacent printhead by at least a distance equal to or greater than a width dimension of each printhead.

6. The pen defined in claim 5 wherein said printheads are mounted on one substrate which is spaced from buss lines and integrated circuit packages on another underlying supporting substrate, with all of said printheads, integrated circuit packages and said buss lines being electrically interconnected for providing power and drive signals to said printheads.

7. The printhead array defined in claim 5 wherein said printheads, driver integrated circuits and said buss lines are all disposed on a common substrate and electrically interconnected thereon.

8. The array defined in claim 7 wherein said buss lines are disposed on said common substrate, interconnected to said printheads and to said integrated circuit packages and extend to the edge of said substrate for connection to off-substrate external circuitry.

9. The pen defined in claim 5 which further includes:
   a. means adjacent said substrate for providing accessible buss lines therefor, and
   b. circuit means interconnecting said printheads and said buss lines for providing electrical drive signals for said printheads.

10. The pen defined in claim 9 wherein said circuit means is a tape automated bond flexible circuit which electrically connects said printheads to said integrated circuits and includes buss lines thereon for providing power and drive signals to said integrated circuits and printheads.

11. An ink jet pen comprising an insulating substrate and a plurality of discrete, thin film printheads mounted thereon, said printheads each having a plurality of ink propulsion transducers therein for propagating ink through ink ejection orifices in an orifice plate adjacent thereto, and separate ink flow paths feeding through said insulating substrate to said printheads, respectively, and each of said plurality of discrete thin film printheads being laterally offset with respect to each adjacent printhead by at least a distance equal to or greater than a width dimension of each thin film printhead, whereby large area bonding stresses between said printheads and said insulating substrate are minimized.

12. The pen defined in claim 11 wherein said transducers are heater resistors.

13. The pen defined in claim 11 wherein said printheads are mounted together with integrated circuit packages and buss lines on a common substrate for electrical connection to each other and to external circuitry.

14. The pen defined in claim 11 wherein said printheads are mounted on one substrate which in turn is mounted on another underlying substrate carrying one or more buss line members and a plurality of integrated circuit packages thereon which are electrically interconnected to each other.

15. The pen defined in claim 13 wherein said printheads and integrated circuit packages are electrically interconnected by way of a thin flat flexible cable.

16. The pen defined in claim 14 wherein said printheads and integrated circuit packages are electrically interconnected by way of a thin flat flexible cable.

17. A method for manufacturing an ink jet pen so as to minimize bonding stresses otherwise created when large area metal orifice plates are bonded to matching large area insulating substrates and for further minimizing the effects of a mismatch in thermal expansion coefficients between a supporting substrate and ink ejection means disposed thereon, which comprises the steps of:

a. providing a plurality of ink feed ports in a common insulating substrate, b. dividing said ink ejection means into a plurality of discrete ink jet printheads, each having separate ink propulsion transducer elements thereon and aligned with an adjacent orifice plate, c. mounting each of said ink jet printheads at predetermined spaced positions on said common insulating substrate and fluidically coupled to said ink feed ports, respectively, whereby said pen is suitable for wide area or wide swath ink jet printing, and d. laterally offsetting each printhead with respect to each adjacent printhead by at least a distance equal to or greater than a width dimension of said printhead.

* * * * *

UNITED STATES PATENT AND TRADEMARK OFFICE

CERTIFICATE OF CORRECTION

PATENT NO. : 5,016,023

DATED : May 14, 1991

INVENTOR(S) : C.S. Chan, Conrad L. Wright, Gary E. Hanson

It is certified that error appears in the above-identified patent and that said Letters Patent is hereby corrected as shown below:

Column 2, line 66 of the Patent, after "are", insert --described, for example, in U.S. Patent No. 4,635,073 issued to--.

In Claim 5, column 8, line 24 of the Patent, after "printheads", delete "therein", insert --thereon--.

Signed and Sealed this

Twenty-second Day of September, 1992

*Attest:*

DOUGLAS B. COMER

*Attesting Officer*

*Acting Commissioner of Patents and Trademarks*